US005381867A

United States Patent [19]

Berry

[11] Patent Number: 5,381,867

[45] Date of Patent: Jan. 17, 1995

[54] TOP DRIVE TORQUE TRACK AND METHOD OF INSTALLING SAME

[75] Inventor: Joe R. Berry, The Woodlands, Tex.

[73] Assignee: Bowen Tools, Inc., Houston, Tex.

[21] Appl. No.: 217,689

[22] Filed: Mar. 24, 1994

[51] Int. Cl.[6] ..... E21B 19/00

[52] U.S. Cl. ..... 175/85

[58] Field of Search ..... 175/85, 52, 162, 220; 166/77, 77.5, 85

[56] References Cited

U.S. PATENT DOCUMENTS

| | | | |
|---|---|---|---|
| 1,375,092 | 4/1921 | Hanson . | |
| 1,395,706 | 11/1921 | Greve . | |
| 2,979,143 | 4/1961 | Kandle . | |
| 2,998,084 | 8/1961 | Johnson et al. . | |
| 3,009,521 | 11/1961 | Failing . | |
| 3,126,063 | 3/1964 | Pitt et al. . | |
| 3,404,741 | 10/1968 | Gheorghe et al. . | |
| 3,464,507 | 9/1969 | Alexander et al. . | |
| 3,766,991 | 10/1973 | Brown . | |
| 3,857,450 | 12/1974 | Guier . | |
| 3,915,244 | 10/1975 | Brown . | |
| 4,126,193 | 11/1978 | Brown . | |
| 4,147,215 | 4/1979 | Hodge et al. . | |
| 4,421,179 | 12/1983 | Boyadjieff . | |
| 4,449,596 | 5/1984 | Boyadjieff . | |
| 4,610,315 | 9/1986 | Koga et al. . | |
| 4,625,796 | 12/1986 | Boyadjieff . | |
| 4,667,752 | 5/1987 | Berry et al. | 175/85 |
| 4,834,604 | 5/1989 | Brittain et al. | 175/85 X |
| 4,865,135 | 9/1989 | Moses . | |
| 5,107,940 | 4/1992 | Berry . | |
| 5,251,709 | 10/1993 | Richardson . | |

FOREIGN PATENT DOCUMENTS

| | | |
|---|---|---|
| 157230 | 1/1982 | Norway . |
| 164557 | 3/1983 | Norway . |

OTHER PUBLICATIONS

*World Oil*, "DC electric power swivel can save time and money", pp. 36–39, Jan. 1972.

*World Oil*, "More about New Equipment", p. 257, Apr., 1979.

*Primary Examiner*—Michael Powell Buiz

*Attorney, Agent, or Firm*—Pravel, Hewitt, Kimball & Krieger

[57] ABSTRACT

An improved top drive torque track system and method of installation. The apparatus includes a plurality of elongated segments having male and female ends and a mechanism for drawing up and securing adjacent members together. The installation process includes suspending adjacent segments from the top drive unit and threadably engaging the sections using a securing system which sequentially mates adjacent elongated housings until a torque track system the length of the mast is assembled.

7 Claims, 6 Drawing Sheets

FIG. 9
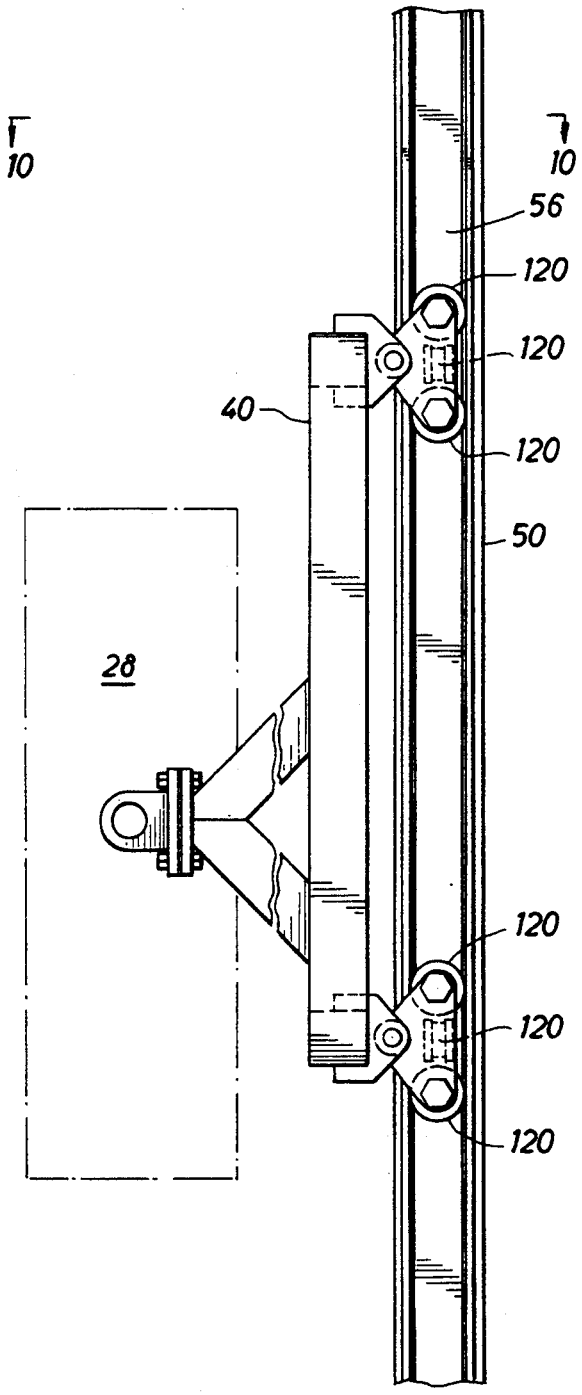
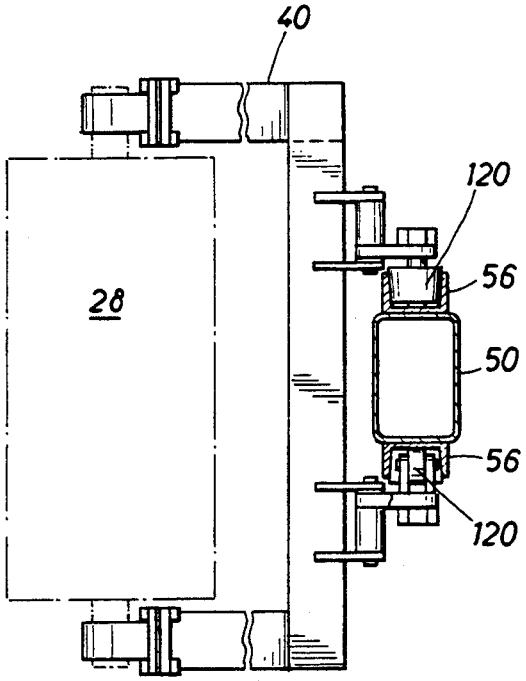
FIG. 10

TOP DRIVE TORQUE TRACK AND METHOD OF INSTALLING SAME

BACKGROUND OF THE INVENTION

1. Field of the Invention

The present invention relates to an improved guide track for an oilfield drilling rig and method of installing same. More particularly, the present invention relates to an improved track system which guides a top drive torque assembly substantially parallel to the longitudinal axis of the mast of a drilling rig and the method for installing same.

2. Description of the Prior Art

It is well known in the prior art to use a top drive drilling unit to rotate the drill stem of an oil and gas well. See, for example, U.S. Pat. Nos. 4,449,596; 3,464,507; and 3,766,991. Such a top drive drilling unit is suspended by cable from the crown of a mast of a drilling rig above the drill string. Essentially, the unit rotates the drill string from the top side as opposed to the use of a rotary table, kelly and related equipment at the rig floor.

The use of such a top drive unit requires a track which runs the length of the mast to guide the drilling mast, to restrain it from lateral movement and to transfer torsional loads originating from the rotary drilling operation into the rig. Such torque drive track systems are disclosed in Moses, U.S. Pat. No. 4,865,135 and Richardson, U.S. Pat. No. 5,251,709. However, the use of previously known track systems has several disadvantages. First, it is difficult to assemble and disassemble such track systems due to their configuration and weight. Due to the height of some derricks (over 100 feet), a track system can weigh substantially in excess of 12,000 pounds. Thus, it can be particularly difficult to assemble a prior art track system at a remote location.

Accordingly, there is a need for an improved top drive track system which is simple to assemble and relatively lightweight, and is also capable of providing lateral load restraint and structural rigidity to transfer torsional loads from the drilling unit into the main structural framework of the drilling rig.

SUMMARY OF THE INVENTION

The present invention provides an improved top drive torque track. The apparatus includes an improved connector for attaching a plurality of elongated hollow housings. Each housing has a male pin at one end and a female box at the other. The apparatus also includes means for drawing up and securing the male pin of one housing into the female box of an adjacent housing as well as a means for guiding the top drive drilling unit along the exterior of the housings once assembled.

Preferably, the drawing means includes the use of two end connectors attached to a movable system for advancing the two connectors together thereby joining two adjacent housings. Such a connecting system includes the use of an elongated threaded bolt which passes through a nut suspended between plates. By threadably engaging the bolt within the nut the drawing means advances the top male pin of one elongated member into the female box of an adjacent housing thereby securing two adjacent members.

The method of the present invention permits the assembly of a top drive torque track wherein rotational movement of a bolt at the lower end of one particular housing serves to raise that housing into mateable engagement with an adjacent housing. The mast's crown block is used to raise the individual housings sequentially until the torque track is assembled.

This description is intended as a summary only. The specific details of the invention are described in the specification and follow in the claims appended hereto.

BRIEF DESCRIPTION OF THE DRAWINGS

In order to more fully understand the drawings referred to in the detailed description of the present invention, a brief description of each drawing is provided.

FIG. 9 is an elevational view of a portion of the present invention.

FIG. 10 is a cross-sectional view taken along line 10—10 of FIG. 9.

DESCRIPTION OF THE PREFERRED EMBODIMENT

Figures 1, 2:
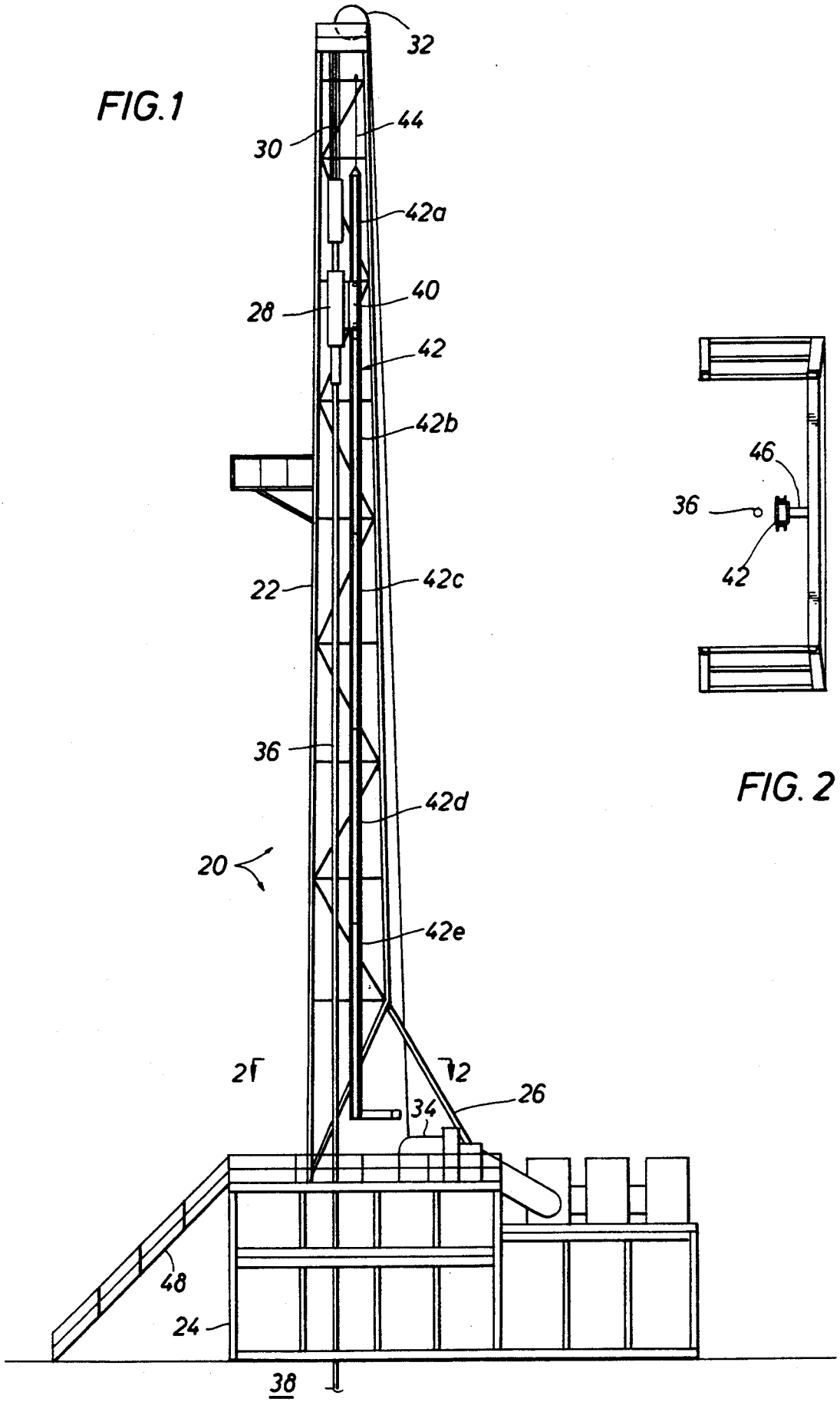
FIG. 1 is an elevational view of a drilling rig showing the present invention installed.
FIG. 2 is a cross-sectional view taken along lines 2—2 of FIG. 1.

Referring to FIGS. 1–2, a conventional drilling rig 20 is shown having a mast 22, substructure 24, and A-frame 26 which helps support and stabilize mast 22 on rig substructure 24. Also shown is a top drive drilling unit 28 suspended from cable arrangement 30, a portion of which loops around crown block 32 and, in turn, is tensioned for upward movement by motor 34 supported at the rig floor. A drill string 36 is suspended by top drive drilling unit 28 which includes a power swivel to rotate the drill string 36. The drill string 36 passes through rig substructure 24 into the ground 38.

Top drive unit 28 includes a carriage assembly 40 which moves along torque track 42. Torque track 42 is comprised of a series of track segments **42*a*–42*e*. At its upper end, torque track 42 is suspended by a cable 44 which is attached to the structural framework of mast 22. At its lower end, torque track 42 is attached by member 46 back to mast 22 and A-frame 26. The tieback shown in FIG. 2 is also referred to occasionally as a strong back. In this manner, any torsional load which is introduced into torque track 42 is resisted by the strong back frame arrangement which transmits most of the torsional loads and forces into substructure 24 rather than mast 22**.

Referring still to FIG. 1, a pipe handling ramp 48 is shown adjacent substructure 24. Typically, such a ramp is used to support sections of drill pipe but in the case of the present invention, it is used to support segments 42*a*–42*e* of track 42 during assembly as discussed below.

Referring now to FIGS. 3–8, the present invention is comprised of a series of track segments 42*a–e* as shown in FIG. 1. However, the invention may comprise any number of track segments 42 depending upon the length of the track segment and the height of the mast to be accommodated. Typically, such segments will be twenty to thirty feet in length. Additionally, it may be necessary to have a series of shorter segments in order to cover the full length of the mast as shown in FIG. 1 and insure that the track, once assembled, is long enough to span from support cable 44 at the top of the mast and engage member 46 at the base.

Figure 6:
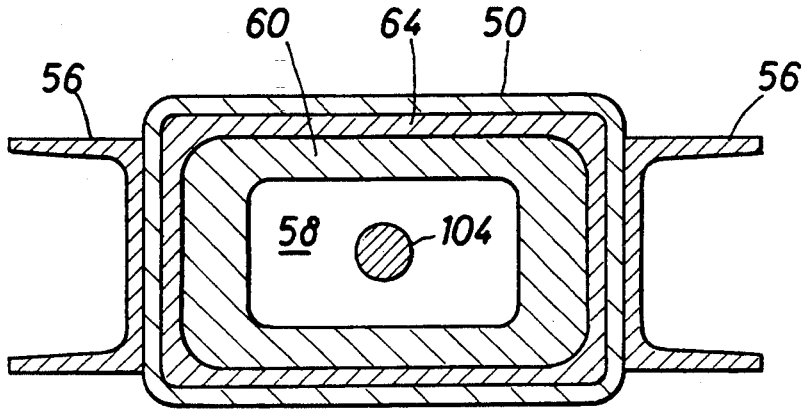
FIG. 6 is a cross-sectional view taken along line 6—6 of FIG. 5.
Figure 7:
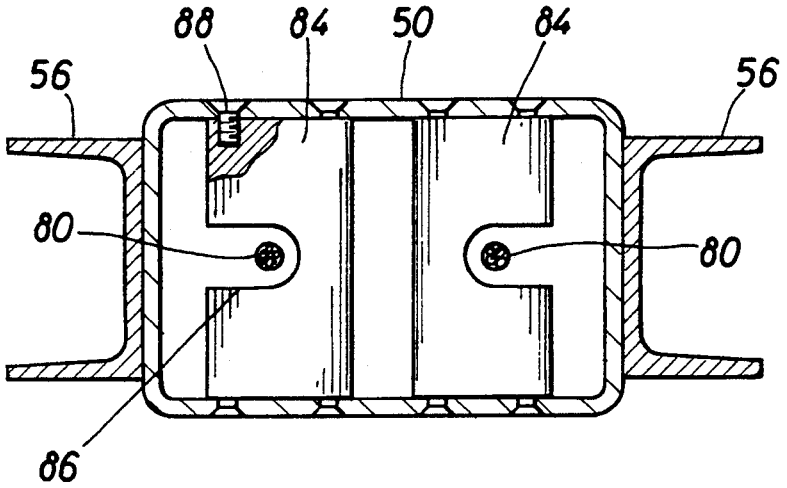
FIG. 7 is a cross-sectional view taken along line 7—7 of FIG. 5.
Figure 8:
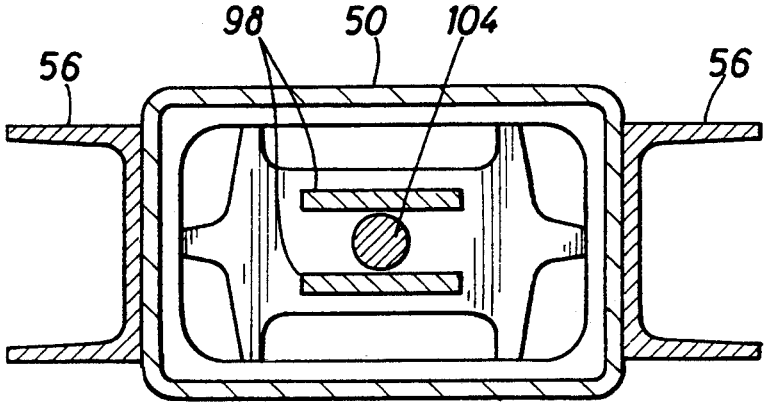
FIG. 8 is a cross-sectional view taken along line 8—8 of FIG. 5.

Each track segment 42 is comprised of a hollow elongated member 50 which is generally rectangular in cross-section (see FIGS. 6–8). Each segment 42 also includes a male pin end 52 and a female box end 54.

Figures 3, 13:
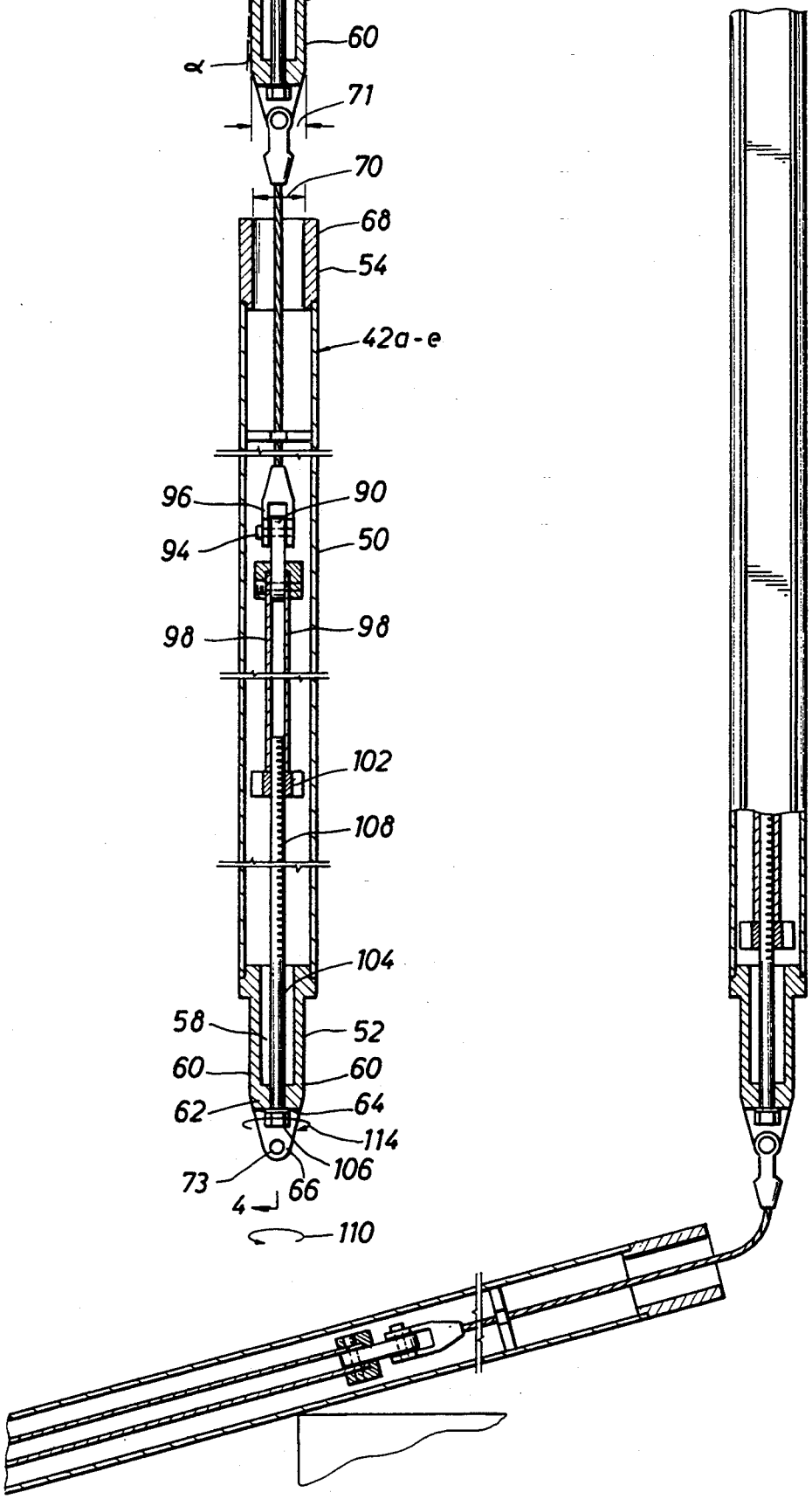
FIG. 3 is a cross-sectional view of the present invention showing two adjacent housings in a disassembled state.
FIG. 13 is a view partly in section showing the installation of the present invention.
Figure 4:
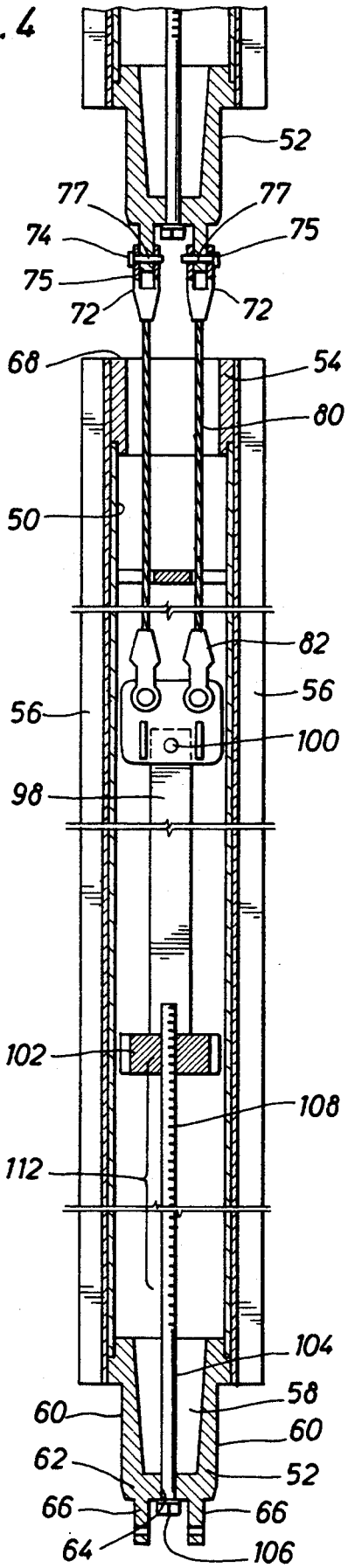
FIG. 4 is a cross-sectional view taken along line 4—4 of FIG. 3.

Referring now to FIGS. 3 and 4, male end 52 includes a hollow bore 58 defined by side walls 60. Bottom wall 62 defines the closure end of bore 58 of male end 52. Bottom plate 62 includes an aperture 64 which passes therethrough. Additionally, each male end 52 includes eyelets 66 which are attached to bottom plate 62.

Each female end 54 is comprised of side walls 68. The thickness of each side wall 68 is selected so that distance 70 will provide a snug fit with dimension 71 of male end 52. For example, male end 52 and the female end 54 may be cast and dimensions 70/71 selected to be within a tolerance of at least +/− 0.020 inches. Dimension 71 of the male end should be cast closer to the high side of the tolerance and then surface finished to obtain an acceptable fit. Additionally, due to casting requirements, it may be preferable to include a draft angle $\alpha$ [between a vertical axis and the surface of side wall 60]. Preferably, angle $\alpha$ should be between $\frac{1}{2}°$ and 1°. This will allow an adequate amount of play in the assembly stage (described below) to accommodate minor misalignments.

The present invention also includes a system for connecting adjacent segments 42 and advancing adjacent segments into a mateable engagement to effect assembly.

Referring still to FIGS. 3–8, the present invention includes connectors 72 which engage eyelets 66. Each eyelet 66 includes an aperture 73. Each connector 72 includes legs 75 having apertures 77. Pin 74 pass through aperture 77 of leg 75 and aperture 73 of eyelet 66. In this manner, each connector 72 is secured to each eyelet 66 of male end 52. A cable 80 is secured to each connector 72. An opposite connector 82, generally identical to connector 72, is attached at the opposite end of each cable 80. Referring to FIG. 7 briefly, the present invention may include a series of plates 84 which span the width of housing 50. Each plate 84 includes a notched segment 86 through which cable 80 passes. Plates 84 may be attached to housing 50 by screws 88. In this manner, plates 84 serve to separate cables 80 and position them in a spaced manner throughout the length of each housing 50. Plates 84 may be positioned at any length along housing 80 to provide adequate separation of cables 80 yet not impact the operation of the connector system as disclosed herein.

Returning to FIGS. 3–5, the connector system includes a plate 90 having apertures 92 to receive pins 94 which pass through legs 96 of connectors 82. In this manner, connectors 82 may be securely attached to plate 90. A pair of elongated plates 98 are attached on either side of plate 90 with pin 100. In this manner, plate 90 serves to equalize the tensile load transferring from plates 98 into cables 80. A threaded nut 102 is welded or otherwise attached at the other end of plates 98.

The connector system also includes a bolt 104 having a head 106 which is adapted to seat against bottom wall 62. Bolt 104 includes a threaded portion 108 adapted to threadably engage nut 102.

Figure 5:
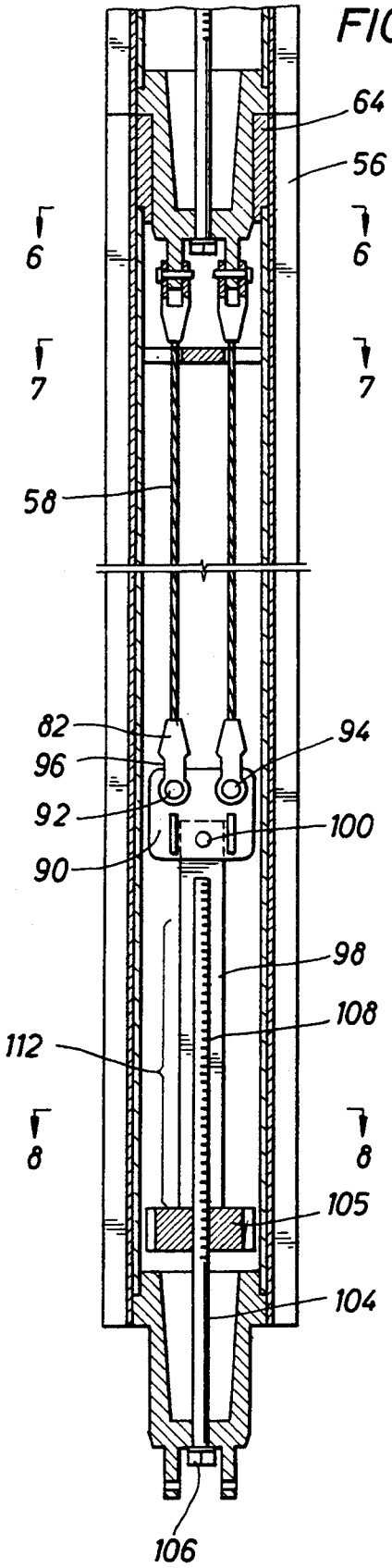
FIG. 5 is a cross-sectional view of the present invention showing two adjacent housings in an assembled state.

Referring still to FIGS. 3–5, the operation of the connector system will be described in more detail. Initially, a top segment 42 is suspended as shown in FIG. 3. Head 106 of bolt 104 of adjacent segment 42 is rotated in a counterclockwise direction as shown by arrow 110. This would unscrew bolt 104 off of nut 102. Comparing the threaded portion 108 of bolt 104 as shown in FIGS. 4 and 5, bolt 104 is unscrewed enough so that portion 112 of threaded portion 108 (which is located above nut 102 in FIG. 5 for example) is located below nut 102 in FIG. 4. In other words, bolt 104 is unscrewed enough to permit an operator to pull connector 72 past the top surface of female connector 54 of bottom segment 42 and engage it with the eyelets 66 of adjacent male end 52. At that point, the top housing is raised by the top drive unit/crown block, as described below, until such time as the second segment 42 is hanging vertically as generally shown in FIG. 3. At that point, an operator would rotate head 106 of bolt 104 in a clockwise direction as shown by arrow 114 until threaded portion 112 is above bolt 102 as shown in FIG. 5. As head 106 is being rotated in a clockwise direction, it is raising lower segment 42, and advancing the top female end onto the male end of the immediately adjacent segment. After threaded portion 112 has passed through bolt 102, the two ends are secured as shown in FIG. 5.

As noted above, preferably each elongated housing 50 is 30 feet in length, and side wall 68 of female end 54 is approximately ten inches in height. Thus, when joined each segment is approximately 31 feet in length. This coincides with the length of drill string joint which facilitates the handling of each section during assembly and disassembly as described below. Additionally, threadable portion 112 of bolt 104 is preferably thirty inches in length. This provides enough clearance between an eyelet 66 of a male end of a hanging track segment 42 and an immediately adjacent female end lying on pipe ramp 48 awaiting installation to make the connection with connector 72. Referring briefly to FIGS. 6–8, channel irons 56 (also referred to as tracks) are attached at opposite sides of housing 50. Tracks 56 provide lateral restraint for rollers 120 of carriage 40 (see FIG. 9).

Figure 11:
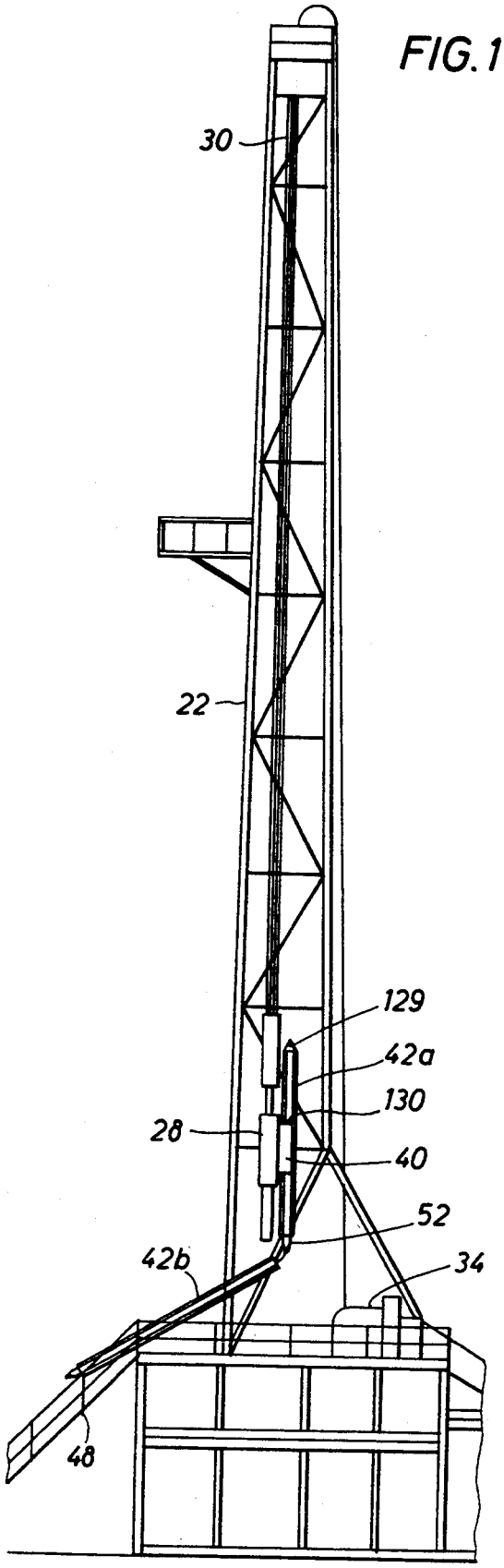
FIG. 11 is a elevational view of a drilling rig showing the installation of the present invention.
Figure 12:
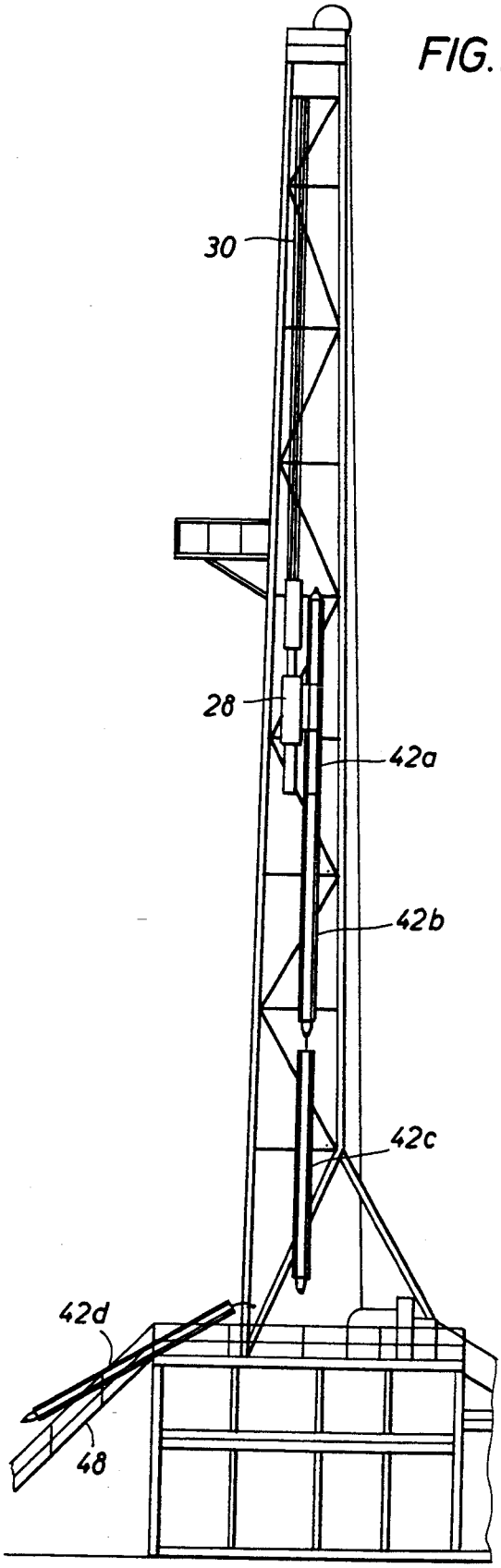
FIG. 12 is an elevational view of a drilling rig showing the continued installation of the present invention.

Referring now to FIGS. 11–13, the method of the present invention is disclosed. Initially, a series of segments 42 are laid across pipe ramp 48. With reference to FIG. 11, first segment 42*a* has been attached to carriage 40. Preferably, this is accomplished by attaching segment 42*a* to the top drive unit 28/carriage 40 before it is hoisted up by cable 30. First segment 42*a* may be prevented from slipping off rollers 120 by the use of a strike plate 130 which straddles each track 56.

Thus, plate 130 acts as a stop and permits first segment 42*a* to be hung from carriage 40. At that point, connectors 72 from second segment 42*b* are attached to the male end 52 of first segment 42*a*. Motor 34 is then activated lifting torque drive drilling unit 28 and raising first segment 42a until such time as segment 42b is vertically suspended beneath it.

Referring now to FIG. 12, the installation of a third section 42c is shown suspended below segment 42b but not yet fully engaged. To fully seat segment 42b within segment 42c an operator would turn head 106 of bolt 104 passing through male end 52 of segment 42c. Thus, bolt 104 would threadably advanced up nut 102 as discussed above with respect to FIGS. 3–5 advancing the male end 52 of second segment 42b into the female end 54 of third segment 42c. The operator would continue rotating bolt head 106 until the male end of segment 42b is secure within the female end of segment 42c. At that point, the operator would attach connector 72 of segment 42d (which is resting on pipe ramp 48) to the male end of segment 42c. Once again, motor 34 is activated raising the top drive drilling unit 28 through the cable system 30 until segment 42d is vertically suspended, and the process continues until such time as the top drive torque track system 42 spans substantially the length of the mast 22. Once fully installed, top suspension cable 44 is tied off to the structure of the mast 22 and the bottom portion of the last segment 42 is attached to member 46 thereby securing the bottom of the track torque system to the strong arm of A-frame 26.

In this manner, a rigid torque track system has been provided which is adequately supported at the base to transfer torsional loads transmitted through the top drive drilling unit 28 to the track torque system 42 out into the substructure 24. Additionally, the geometry of the present invention provides optimum rigidity with minimal weight. Optimal rigidity is provided through the use of a single elongated housing member in preferably rectangular configuration for maximum stability in both horizontal directions.

The foregoing disclosure and description of the invention are illustrative and exemplary. Various changes in size, shape, materials of construction, and configuration as well as changes in details in the illustrated construction and assembly may be made within the scope of the appended claims and without departing from the spirit of the invention.

What is claimed is:

1. In a drilling rig system having a mast and a top drive drilling unit, an improved track system comprising:

a plurality of elongated hollow housings, each having a male pin at one end and a female box at the other end;

means for drawing up and securing the male pin of one housing into the female box of an adjacent housing; and means for guiding said top drive drilling unit along the exterior of said housings.

2. The improved track system according to claim 1 wherein said track system further comprises:

a first connector connected to the male pin of one housing;

a second connector connected to the male pin of an adjacent housing; and means for advancing said second connector toward said first connector so as to draw said male pin of one housing into said female box of said adjacent housing and secure said one housing to said adjacent housing.

3. The improved track system according to claim 2 wherein said advancing and securing means comprises:

an elongated member secured at one end to said first connector and having a threaded member at its other end;

an elongated shaft having a threaded portion and a head opposite said threaded portion, said threaded portion being engageable with said threadable member of said elongated member and said head being connected to said second connector so that threadable rotation of said elongated shaft in one direction rotates said elongated shaft within said threaded member advancing said second connector towards said first connector.

4. In a drilling rig system having a mast and a top drive drilling unit, an improved track system comprising:

a plurality of elongated hollow housings, each housing having a male pin at one end and a female box at the other end;

means for guiding said top drive drilling unit along said housings;

a first connector positioned within said housing and connected to the male pin of one housing;

a second connector positioned within an adjacent housing and connected to the male pin of said adjacent housing; and means for advancing said second connector towards said first connector so as to draw said male pin of said one housing into the female box of said adjacent housing and securing said one housing within said adjacent housing.

5. In a drilling rig system having a mast and a top drive drilling unit, an improved track system comprising:

a plurality of elongated hollow housings, each having a male pin at one end and a female box at the other end;

means for drawing up and securing the male pin of one housing end into the female box of an adjacent housing;

means for guiding said top drive drilling unit along the exterior of said housings;

a first connector connected to the male pin of one housing;

a second connector connected of the male pin of an adjacent housing;

a elongated member secured at one end to said first connector and having a further member at its other end; and an elongated shaft having a threaded portion and a head opposite said thread portion, said threaded portion being engageable with said threaded member of said elongated member and said head being connected to said second connector so that threadable rotation of said elongated shaft in one direction rotates said elongated shaft within said threaded member advancing said second connector towards said first connector.

6. In a drilling rig system having a mast and a top drive drilling unit, an improved track system comprising:

a plurality of elongated hollow housings, each housing having a male pin at one end and a female box at the other end;

means for guiding said top drive drilling unit along said housing;

a first connector positioned within said housing and connected to the male pin of one housing;

a second connector positioned within an adjacent housing and connected to the male pin of said adjacent housing;

an elongated member positioned within said housing and being secured at one end to said first connector and having a threaded member at its other end;

an elongated shaft having a threaded portion and a head opposite said threaded portion, said threaded portion being engageable with said threaded member of said elongated member and said head being connected to said second connector so that threadable rotation of said elongated shaft relative to said threaded member in a first direction advances said second connector towards said first connector drawing up and securing the male pin of one housing into the female box of an adjacent housing, and rotation of the elongated shaft in a second direction relative to said threaded member loosens the engagement of the male pin of one housing within the female box of said adjacent housing permitting the separation of one housing relative to said adjacent housing.

7. A method of installing a top drive torque track system in a drilling rig having a mast and a travelling block, a plurality of elongated segments with a male pin at one end and a female box at the other end of each segment, and a securing system for drawing up and securing adjacent elongated segments, said system having a top connector and a bottom connector for each segment, the method comprising the steps of:

(a) raising a first segment using the travelling block;

(b) attaching one end of the securing system to the male pin of the first segment;

(c) raising the second segment by raising the first segment using the travelling block;

(d) rotating the second connector relative to the first connector of the securing system of said second segment;

(e) advancing the second segment into mateable engagement with the first segment;

(f) repeating steps (a)–(e) with multiple segments until the first segment reaches the top of the mast;

(g) suspending the first segment from the top of the mast; and (h) attaching the bottom of the last segment to the support frame of the drilling rig.

* * * * *